US006779995B2

(12) United States Patent
Kohara et al.

(10) Patent No.: US 6,779,995 B2
(45) **Date of Patent: *Aug. 24, 2004**

(54) PROCESS AND APPARATUS FOR SUPPLYING RARE EARTH METAL-BASED ALLOY POWDER

(75) Inventors: Seiichi Kohara, Osaka (JP); Shuhei Okumura, Osaka (JP); Akira Nakamura, Osaka (JP)

(73) Assignee: Neomax Co., Ltd., Osaka (JP)

( * ) Notice: Subject to any disclaimer, the term of this patent is extended or adjusted under 35 U.S.C. 154(b) by 42 days.

This patent is subject to a terminal disclaimer.

(21) Appl. No.: 10/212,091

(22) Filed: Aug. 6, 2002

(65) Prior Publication Data

US 2002/0185793 A1 Dec. 12, 2002

Related U.S. Application Data

(62) Division of application No. 09/669,576, filed on Sep. 26, 2000, now Pat. No. 6,481,993, which is a division of application No. 09/472,247, filed on Dec. 27, 1999, now Pat. No. 6,299,832.

(30) Foreign Application Priority Data

Dec. 28, 1998 (JP) ..... 10-377146

(51) Int. Cl.[7] ..... B22F 3/02
(52) U.S. Cl. ..... 425/78
(58) Field of Search ..... 425/78

(56) References Cited

U.S. PATENT DOCUMENTS

| | | | | |
|---|---|---|---|---|
| 3,623,639 A | | 11/1971 | McShirley | 222/108 |
| 4,201,530 A | | 5/1980 | Vogt | 425/260 |
| 4,703,076 A | | 10/1987 | Mori | 524/420 |
| 5,208,293 A | | 5/1993 | Oki et al. | 525/199 |
| 5,300,366 A | | 4/1994 | Nakamaru et al. | 428/549 |
| 5,491,542 A | | 2/1996 | Nagashima et al. | 355/260 |
| 5,590,887 A | | 1/1997 | Senda et al. | 277/205 |
| 5,672,363 A | | 9/1997 | Sagawa et al. | 425/3 |
| 5,900,328 A | | 5/1999 | Chatterjee et al. | 428/701 |
| 6,004,120 A | | 12/1999 | Matsubara et al. | 425/78 |
| 6,039,221 A | | 3/2000 | Chatterjee et al. | 222/361 |
| 6,299,832 B1 | * | 10/2001 | Kohara et al. | 419/38 |
| 6,481,993 B1 | * | 11/2002 | Kohara et al. | 425/78 |

FOREIGN PATENT DOCUMENTS

| | | |
|---|---|---|
| DE | 40 14 266 A1 | 7/1991 |
| JP | 50-32574 | 3/1975 |
| JP | Hei 2-108497 | 4/1990 |
| JP | Hei 6-25707 | 2/1994 |
| JP | 06136403 | 5/1994 |
| JP | Hei 7-242907 | 9/1995 |
| JP | 08130142 | 5/1996 |
| JP | 9-94814 | 4/1997 |
| JP | 09-267195 | 10/1997 |
| JP | Hei 9-327798 | 12/1997 |

* cited by examiner

*Primary Examiner*—Daniel Jenkins
(74) *Attorney, Agent, or Firm*—Armstrong, Kratz, Quintos, Hanson & Brooks, LLP

(57) ABSTRACT

In a rare earth metal-based alloy powder supplying apparatus, a rare earth metal-based alloy powder is supplied from a feeder box having an opening in its bottom surface into a cavity by moving the feeder box to above the cavity. The apparatus includes a bar-shaped member which is moved horizontally and in parallel in the bottom of the feeder box. A plurality of the bar-shaped members may be provided horizontally at distances. The apparatus further includes a powder replenishing device for sequentially replenishing the alloy powder into the feeder box in an amount corresponding to a decrement in amount resulting from the supplying of the alloy powder from the feeder box to the cavity, an inert gas supply device for filling an inert gas into said powder feeder box, and a plate member made of a fluorine-contained resin and mounted on the bottom surface of the feeder box. Thus, an alloy powder extremely poor in fluidity and in agitatability and liable to be inflamed can be supplied into the cavity with an extremely uniform filled density without production of agglomerates and bridges and with no fear of inflammation.

3 Claims, 9 Drawing Sheets

PROCESS AND APPARATUS FOR SUPPLYING RARE EARTH METAL-BASED ALLOY POWDER

This application is a divisional of prior application Ser. No. 09/669,576 filed Sep. 26, 2000 which is a divisional of 09/472,247 filed Dec. 27, 1999, U.S. Pat. No. 6,299,832 now U.S. Pat. No. 6,481,993.

BACKGROUND OF THE INVENTION

1. Field of the Invention

The present invention relates to a process for supplying a rare earth metal-based alloy powder to a cavity in a mold, for example, in order to subject the rare earth metal-based alloy powder to a pressing for producing a rare earth metal-based magnet, and to an apparatus suitable for use in such process. More particularly, the present invention relates to a powder supplying process which is capable of uniformly supplying and filling, into a cavity, even an alloy powder which is poor in flowability and difficult to be filled in a cavity and moreover, is inflammable and difficult to handle, as is the above-described rare earth metal-based alloy powder, without production of agglomerates and bridges and without occurrence of inflammation.

2. Description of the Related Art

To supply a powder poor in flowability from a feeder box into a cavity in a mold, a supplying apparatus is conventionally used, which is designed so that a feeder box having an opening in its bottom is moved to above a cavity defined in a mold, whereby a rare earth metal-based alloy powder is supplied from the feeder box into the cavity. There are such conventionally known powder supplying apparatus in which a rotary blade rotated in the feeder box is used as described in Japanese Patent Application Laid-open No. 59-40560; a spherical member rotated in the bottom of the feeder box, as described in Japanese Patent Application Laid-open No. 10-58198; or a rotary blader rotated spirally within the feeder box is used, as described in Japanese Utility Model Application Laid-open No. 63-110521.

In the above prior art systems; however, the height of the feeder box is increased, and the stroke of a punch is prolonged. Therefore, the time taken for one run of the pressing is prolonged, resulting in a reduced productivity. A powder poor in flowability such as a rare earth metal-based alloy powder cannot be filled uniformly into the cavity, if a uniform urging force is not provided. Particularly a rare earth metal-based alloy powder produced by a strip casting process and having an excellent magnetic characteristic is extremely poor in flowability and difficult to be filled uniformly into the cavity, because it has a small average particle size and a narrow and sharp distribution of particle sizes. Further, when a lubricant such as a fatty ester for enhancing the orientation is added, the alloy powder has an increased viscosity, and hence, is more difficult to be filled uniformly into the cavity.

In addition, in the apparatus having the above-described arrangement, there is a possibility that the rare earth metal-based alloy powder is exposed to the atmosphere to become inflamed, because each of the die surface and the bottom of the feeder box is formed of a metal, and the alloy powder is sometimes caught between them.

SUMMARY OF THE INVENTION

Accordingly, it is an object of the present invention to provide a powder supply process and apparatus for supplying an alloy powder from a feeder box having an opening in its bottom into a cavity defined in a mold by moving the feeder box to above the cavity, wherein even a powder difficult to handle such as a rare earth metal-based alloy powder can be supplied from the feeder box into the cavity under a uniform pressure, as compared with the conventional agitation means, without a fear of inflammation.

To achieve the above object, according to a first aspect and feature of the present invention, there is provided an apparatus for supplying a rare earth metal-based alloy powder from a feeder box having an opening in its bottom surface into a cavity by moving the feeder box to above the cavity, the apparatus comprising a bar-shaped member which is moved horizontally and in parallel in the bottom of the feeder box.

With the above feature, the powder in the feeder box is supplied into the cavity, while reciprocally moving the bar-shaped member in the horizontal direction in the bottom of the feeder box. Therefore, the powder in the feeder box can be supplied into the cavity under a uniform pressure sequentially in an order of from a powder portion present in the vicinity of the bottom to a portion present in the top of the box, and filled with a uniform density without production of agglomerates and bridges.

According to a second aspect and feature of the present invention, in addition to the first feature, a plurality of the bar-shaped members are provided horizontally at distances.

With the above feature, the plurality of the bar-shaped members are provided horizontally at distances and therefore, the alloy powder can be filled more efficiently into the cavity.

According to a third aspect and feature of the present invention, in addition to the second feature, the distance between the bar-shaped members is generally equal to a distance between cavities arranged in a plurality of rows in a direction of arrangement of the bar-shaped members.

With the third feature, the uniform supplying and filling of the powder into each of the cavities disposed in the plurality of rows can be achieved by each of the bar-shaped members. Even if the finally stopping position for the bar-shaped member after the parallel movement thereof has been failed to be established at a point offset from the opening surface of the cavity, each of the bar-shaped members is stopped at the same position relative to each of the cavities and hence, the supplying and filling of the powder can be carried out, so that a variability in amount of alloy powder filled in the cavities is not produced for each of the cavities.

According to a fourth aspect and feature of the present invention, in addition to the first feature, the bar-shaped member is of an arcuate shape in section.

With the fourth feature, the section of the bar-shaped member is of the arcuate shape, but may be of any of polygonal shapes such as triangular, quadrilateral and pentagonal shapes and the like. However, if the section of at least lower half of the bar-shaped member for guiding the alloy powder is of an arc-shape of a circle or an ellipse, the alloy powder coming into contact with the bar-shaped member with the horizontal movement of the bar-shaped member is guided into the cavity, while being moved downwards along a peripheral surface of the bar-shaped member, whereby the supplying and filling of the powder into the cavity can be achieved under an extremely uniform pressure.

According to a fifth aspect and feature of the present invention, in addition to the fourth feature, the bar-shaped member has a diameter in a range of 0.3 to 7 mm.

With the above feature, the diameter of the bar-shaped member is in the range of 0.3 to 7 mm. However, if the diameter of the bar-shaped member is smaller than 0.3 mm, the urging force is insufficient. On the other hand, if the diameter exceeds 7 mm, the pressure applied to the alloy powder during horizontal movement of the bar-shaped member is too high and produces agglomerates in the alloy powder.

According to a sixth aspect and feature of the present invention, in addition to the first feature, the bar-shaped member is disposed, so that the distance between its lower end and a die surface at a peripheral edge of the opening in the cavity is from 0.2 to 5 mm.

With the above feature, the lower end of the bar-shaped member is spaced at a distance of 0.2 to 5 mm apart from the die surface at the peripheral edge of the opening in the cavity. This is because if the distance is smaller than 0.2 mm, the alloy powder is pressed between the die surface at the edge of the opening in the cavity and the bar-shaped member and produces agglomerates in the alloy powder. On the other hand, if the distance exceeds 5 mm, an effect for urging the alloy powder into the cavity under a uniform pressure is not obtained.

According to a seventh aspect and feature of the present invention, an addition to the first feature, another bar-shaped member is also provided at a location above the bar-shaped member provided in the first feature, so that it is moved horizontally and in parallel in the feeder box.

With the above feature, the other bar-shaped member is provided at the location above the bar-shaped member provided in the first feature. Therefore, the unevenness of the alloy powder generated within the feeder box by the supplying of the powder can be eliminated, and the gravitational filling pressure can be uniformized. In addition, the agglomerates produced in the alloy powder in the feeder box can be clashed.

According to an eighth aspect and feature of the present invention, in addition to the first feature, the finally stopping position for the bar-shaped member after the parallel movement is established at a point offset from the opening surface of the cavity.

With the above feature, it is avoided that the finally stopping position for the bar-shaped member after the parallel movement is at any point above the opening surface of the cavity. Therefore, if the bar-shaped member is stopped at above the opening in the cavity, a variability in density is generated in the front and rear portions in the direction of movement of the bar-shaped member, but according to the present invention, it is possible to prevent a high-density portion and a low-density portion from being formed in the rare earth metal-based powder in the cavity. Therefore, it is possible to prevent the cracking of a compact or a sintered product due to the variability in density.

According to a ninth aspect and feature of the present invention, in addition to the first feature, the apparatus further includes a powder replenishing device for replenishing the alloy powder into the feeder box in an amount corresponding to a decrement in amount resulting from the supplying of the alloy powder from the feeder box to the cavity.

With the above feature, the amount of the alloy powder within the feeder box can be maintained constant at all times, and the gravitational filling pressure is not varied, whereby the amount of alloy powder supplied from the feeder box into the cavity is uniformized.

According to a tenth aspect and feature of the present invention, there is provided an apparatus for supplying a rare earth metal-based alloy powder from a feeder box having an opening in its bottom into a cavity by moving the feeder box to above the cavity, the apparatus comprising an inert gas supply device for filling an inert gas into the powder feeder box.

With the tenth feature, the rare earth metal-based alloy powder can be supplied into the cavity, while maintaining the inside of the power feeder box in an inert gas-filled state by provision of the inert gas feeding device for filling an inert gas into the feeder box. In this case, a friction heat generates an inflammable state with the movement of the feeder box and the movement of the bar-shaped member. However, there is no fear of inflammation.

According to an eleventh aspect and feature of the present invention, there is provided an apparatus for supplying a rare earth metal-based alloy powder from a feeder box having an opening in its bottom into a cavity by moving the feeder box to above the cavity, the apparatus comprising a plate member made of a fluorine-contained resin and mounted on the bottom surface of the feeder box.

With the eleventh feature, the risk of inflammation can be reduced by the mounting of the plate member of the fluorine-contained resin on the bottom surface of the feeder box. More specifically, the bottom surface of the feeder box is violently rubbed against a base plate and the die with the reciprocal movement of the feeder box, and the feeder box is moved, while bringing the alloy powder into contact with the base plate. Therefore, if the bottom surface of the feeder box is formed of the same metal as a material for a side face, e.g., a stainless steel (SUS304), the bottom surface of the feeder box is poor in close contact with the base plate and thus, a portion of the alloy powder is bitten between the bottom surface of the feeder box and the base plate. For this reason, even if the inside of a powder accommodating area is put in an inert gas atmosphere, there is a high risk of inflammation. In addition, there is a possibility that a difference in level is generated between the mold and the die set, and a spark is generated between the feeder box and the die set, resulting in a risk of inflammation. Therefore, by mounting the plate member made of a material such as a fluorine-contained resin permitting a good close contact on the bottom surface of the feeder box, it is possible to prevent a portion of the alloy powder from being bitten between the bottom surface of the feeder box and the base plate, and further, a spark is never generated.

According to a twelfth aspect and feature of the present invention, there is provided a process for supplying a rare earth metal-based alloy powder from a feeder box having an opening in its bottom into a cavity by moving the feeder box to above the cavity, wherein the rare earth metal-based alloy powder within the feeder box is supplied into the cavity, while reciprocally moving a bar-shaped member adapted to be moved horizontally in parallel in the bottom of the feeder box.

According to a thirteenth aspect and feature of the present invention, in addition to the twelfth feature, the rare earth metal-based alloy powder contains a lubricant added thereto.

According to a fourteenth aspect and feature of the present invention, in addition to the twelfth feature, the rare earth metal-based alloy powder is produced by a strip casting process.

According to a fifteenth aspect and feature of the present invention, in addition to the twelfth feature, the bar-shaped member is moved in parallel in a direction perpendicular to a lengthwise direction of the opening of the cavity.

According to a sixteenth aspect and feature of the present invention, in addition to the twelfth feature, the feeder box is retreated in a direction perpendicular to a lengthwise direction of the opening of the cavity after supplying of the alloy powder from the feeder box to the cavity.

According to a seventeenth aspect and feature of the present invention, in addition to the twelfth feature, when the feeder box is moved to above the cavity, the bar-shaped member is located in a front portion of the feeder box in a moving direction of the feeder box.

According to an eighteenth aspect and feature of the present invention, in addition to the twelfth feature, a position for stopping the feeder box moving to above the cavity is established at a location where the center of the feeder box is beyond the center of the cavities in the moving direction of the feeder box.

According to a nineteenth aspect and feature of the present invention, in addition to the twelfth feature, the alloy powder is replenished into the feeder box in an amount corresponding to a decrement in amount of the alloy powder resulting from the supplying of the alloy powder from the feeder box into the cavity.

According to a twentieth aspect and feature of the present invention, there is provided a process for supplying a rare earth metal-based alloy powder from a feeder box having an opening in its bottom into a cavity by moving the feeder box to above the cavity, wherein the feeder box is retreated in a direction perpendicular to a lengthwise direction of the opening of the cavity after supplying of the alloy powder from the feeder box to the cavity.

According to a twenty first aspect and feature of the present invention, in addition to the twentieth feature, the rare earth metal-based alloy powder contains a lubricant added thereto.

According to a twenty second aspect and feature of the present invention, in addition to the twentieth feature, the rare earth metal-based alloy powder is produced by a strip casting process.

According to a twenty third aspect and feature of the present invention, there is provided a process for supplying a rare earth metal-based alloy powder from a feeder box having an opening in its bottom into a cavity by moving the feeder box to above the cavity, wherein the feeder box is moved to above the cavity, while filling an inert gas into the feeder box, thereby supplying the rare earth metal-based alloy powder into the cavity.

According to a twenty fourth aspect and feature of the present invention, in addition to the twenty third feature, the rare earth metal-based alloy powder contains a lubricant added thereto.

According to a twenty fifth aspect and feature of the present invention, in addition to the twenty third feature, the rare earth metal-based alloy powder is produced by a strip casting process.

With the above process, it is preferable that the bar-shaped member 21 is moved in parallel in the direction perpendicular to the lengthwise direction of the opening of the cavity 4 which is defined by a die hole 2*b* in a die 2*a* and a lower punch 2, as shown in FIG. 14. This is due to the following reason: When the bar-shaped member 21 is moved in parallel in the lengthwise direction of the opening of the cavity 4, as shown in FIGS. 15 and 16, the alloy powder m in the cavity 4 is pulled in the moving direction with the movement of the bar-shaped member 21, as shown in FIG. 15, because the alloy powder m lacks in flowability. As a result, a variability in density of the alloy powder m supplied into the cavity 4 is liable to be generated in the lengthwise direction. If the variability in density of the alloy powder m is generated in the lengthwise direction, as described above, a variability in size of a sintered product resulting from a sintering step is also generated in the lengthwise direction. However, when the bar-shaped member 21 is moved in parallel in the direction perpendicular to the lengthwise direction of the opening of the cavity 4, the movement of the alloy powder m within the cavity 4 is limited because of a short distance between walls of the cavity 4 which are located at the front and rear portions of the bar-shaped member 21 in the moving direction. Therefore, the variability in density of the alloy powder m within the cavity 4 is difficult to generate, and even if a variability of density of the alloy powder is generated to a small extent, such variability of this extent is corrected by a pressing and hence, a variability in size of the sintered product is not generated.

A variability in density of the alloy powder in the lengthwise direction of the opening of the cavity as described above is also generated upon the retreating movement of the feeder box with the same phenomenon. Therefore, the direction of the retreating movement of the feeder box is also defined as a direction perpendicular to the lengthwise direction of the opening of the cavity 4, whereby the variability in size of the sintered product can be inhibited to inhibit the variability in density of the alloy powder.

When the feeder box is to be moved to above the cavity, if the bar-shaped member is located at a fore end in the moving direction, it is possible to retain the alloy powder in the front portion of the feeder box in the direction of movement of the feeder box. Therefore, it is possible to prevent the alloy powder from being moved and offset backwards as viewed in the advancing direction by the movement of the feeder box, thereby preventing the amount of the alloy powder from being insufficient in the front portion of the feeder box. Thus, the gravitational filling pressure can be uniformized.

The amount of the alloy powder may be insufficient in the front portion of the feeder box and excessive in a rear portion of the feeder box with the movement of the feeder box. Therefore, when the feeder box is moved to above the cavity, it is moved to the location where the center thereof is beyond the center of the cavities. This facilitates the filling of the alloy powder into the cavity under a uniform pressure.

Thus, with the alloy powder supplying process and apparatus according to the present invention, even a rare earth metal-based alloy powder containing a lubricant added thereto, even a rare earth metal-based alloy powder having a viscosity and extremely poor in flowability and in agitatability, even a rare earth metal-based alloy powder produced by the strip casting process, and even a rare earth metal-based alloy powder extremely poor in flowability because of a narrow and sharp distribution of particle sizes, can be supplied into the cavity with an extremely uniform filled density without production of agglomerates and bridges and with no fear of inflammation.

The above and other objects, features and advantages of the invention will become apparent from the following description of the preferred embodiment taken in conjunction with the accompanying drawings.

DETAILED DESCRIPTION OF THE PREFERRED EMBODIMENTS

The present invention will now be described by way of a preferred embodiment of the present invention with reference to the accompanying drawings.

First, a rare earth metal-based alloy powder used in the embodiment will be described below.

The rare earth metal-based alloy powder was produced in the following manner:

First, an ingot was produced using a strip casting process as described in U.S. Pat. No. 5,383,978.

More specifically, an alloy produced by a known process and having a composition comprising 30% by weight of Nd, 1.0% by weight of B, 1.2% by weight of Dy, 0.2% by weight of Al, 0.9% by weight of Co and the balance of Fe and inevitable impurities, was subjected to a high frequency melting process to provide a molten metal. The molten metal was maintained at 1,350° C. and then quenched on a single roll under conditions of a roll peripheral speed of about 1 m/sec, a cooling rate of 500° C./sec and a sub-cooling rate of 200° C./sec, thereby providing a flake-shaped alloy ingot having a thickness of 0.3 mm.

Then, the alloy ingot was pulverized coarsely by a hydrogen-occlusion process and then pulverized finely in an atmosphere of nitrogen gas, using a jet mill, thereby providing an alloy powder having an average particle size of 3.5 $\mu$m.

Subsequently, a solution of a fatty ester as a lubricant diluted in a petroleum solvent was added and mixed in an amount of 0.3% by weight in terms of the lubricant with the alloy powder in a rocking mixer, whereby the lubricant was coated onto the surface of the alloy powder. The fatty ester used was methyl caproate, and the petroleum solvent used was iso-paraffin. The ratio by weight of the methyl caproate to the iso-paraffin was 1:9.

The composition of the rare earth metal-based alloy may be one described in U.S. Pat. No. 4,770,423 and the like, in addition to the above-described composition.

The type of the lubricant is particularly not limited, and for example, a solution of another fatty ester diluted in a solvent may be used. Example of the fatty esters which may be used are methyl caprylate, methyl laurate, methyl laurylate and the like. Examples of the solvent which may be used are petroleum solvent such as iso-paraffin, naphthenic solvent and the like, and a mixture of a fatty ester and a solvent at a ratio by weight equal to 1:20 to 1:1 may be used. A solid lubricant such as zinc stearate maybe used in replace of, or in combination with the liquid lubricant.

An apparatus for supplying a rare earth metal-based alloy powder according to the present invention will now be described below.

Figure 1:
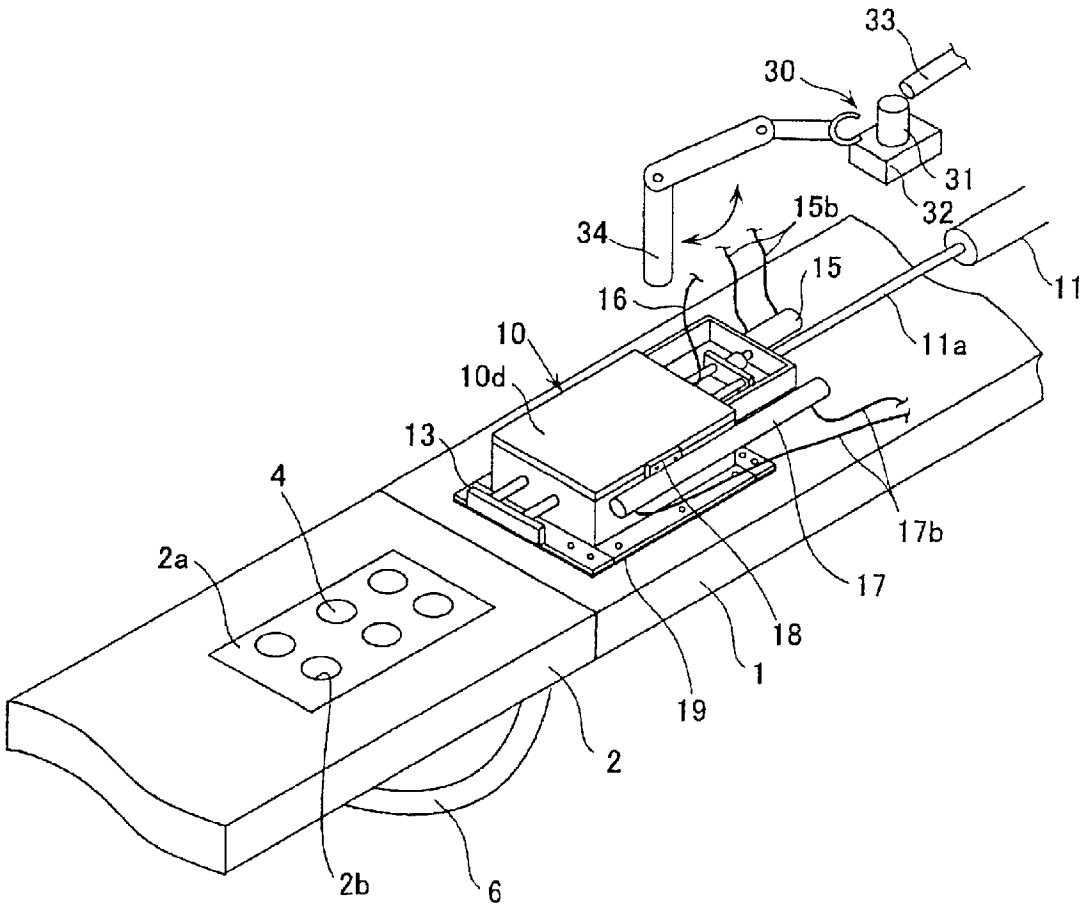
FIG. 1 is a perspective view of one embodiment of a pressing system equipped with a powder supplying apparatus according to the present invention.

FIG. 1 is a perspective view of the entire arrangement of a pressing system equipped with the rare earth metal-based alloy powder supplying apparatus according to the present invention.

In FIG. 1, reference character 1 designates a base plate. A die 2*a* is fitted in a die set 2 disposed adjacent to the base plate 1, and has a die hole 2*b* vertically provided therethrough. A lower punch 3 is disposed, so that they can be fitted into the die hole 2*b* from the below, whereby a cavity 4 of any volume is defined by an inner peripheral surface of the die hole 2*b* and an upper end face of the lower punch 3.

In FIG. 1, reference character 5 designates an upper punch. An alloy powder m is supplied into the cavity 4 by a feeder box 10, and the feeder box 10 is moved away from the cavity. Then, the upper punch 5 is inserted into the cavity 4 to compress the alloy powder m by cooperation with the lower punch 3, thereby forming a green compact of the alloy powder. In this embodiment, a total of six cavities 4 are provided in three rows in a direction of movement of the feeder box 10, with the two cavities 4 being in each row.

A magnetic field generating coil 6 is disposed below the die 2*a* to generate an oriented magnetic field by cooperation with a magnetic field generating coil (not shown) provided in the vicinity of the upper punch 6 disposed above the die 2*a*.

The feeder box 10 is mounted on the base plate and adapted to be reciprocally moved between a position on the die 2*a* and a standby position by a cylinder rod 11*a* of an air cylinder 11. A replenishing device 30 is provided in the vicinity of the standby position for replenishing the rare earth metal-based alloy powder m to the feeder box 10.

The detail of the replenishing device 30 will be described below. A feeder cup 32 is placed on a balance 31, so that the alloy powder m is dropped little by little into the feeder cup 32 by a vibration trough 33. This weighing operation is conducted while the feeder box 10 is being moved on the die 2*a,* and when the feeder box 10 has been moved back to the standby position, the alloy powder m is replenished to the feeder box 10 by a robot 34. The amount of the powder m placed into the feeder cup 32 corresponds to an amount of powder m reduced within the feeder box 10 by one run of the pressing operation, so that the amount of the alloy powder m within the feeder box 10 is always constant. As a result of the amount of the powder m within the feeder box 10 being maintained constant in the above manner, the pressure provided upon the gravitational filling pressure of the powder into the cavity 4 is constant, whereby the amount of alloy powder m filled into cavity 4 is constant.

Figure 2:
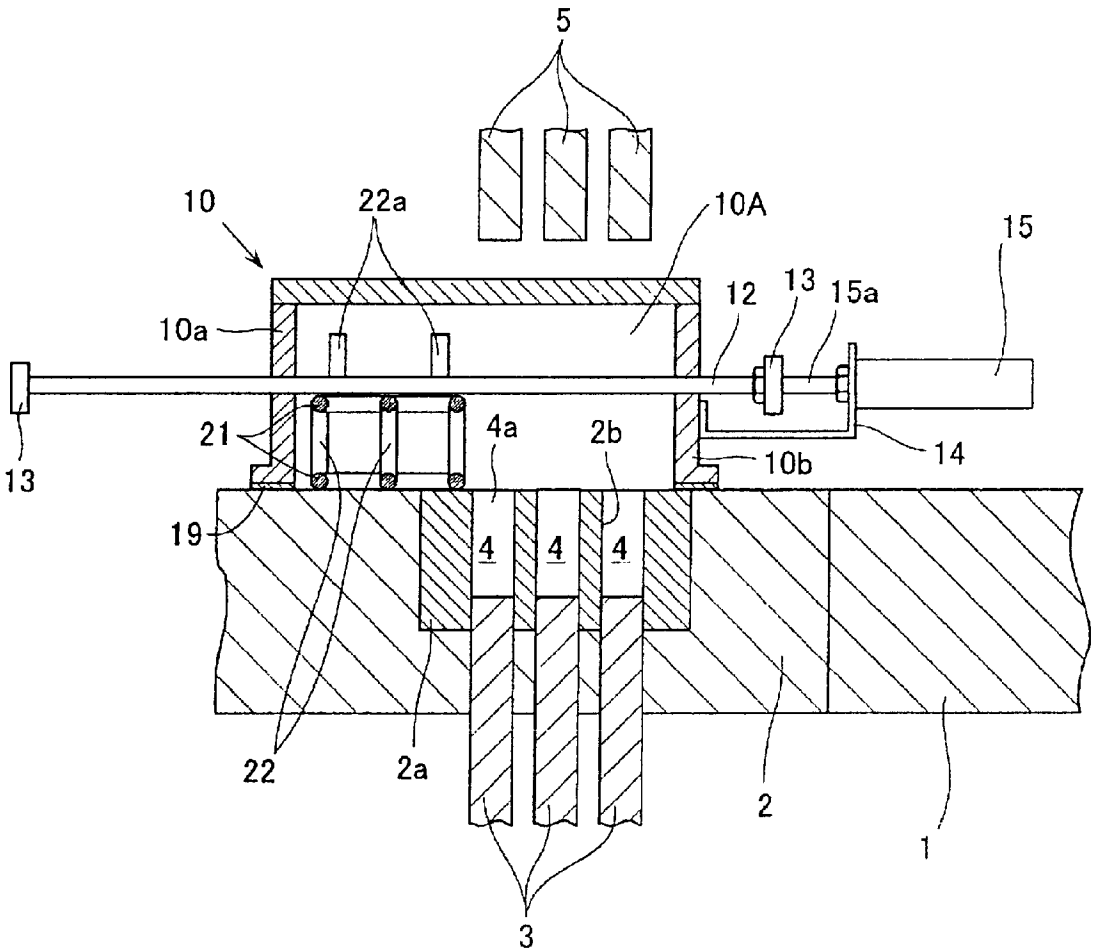
FIG. 2 is a side sectional view of a portion of the pressing system in the vicinity of the feeder box.
Figure 3:
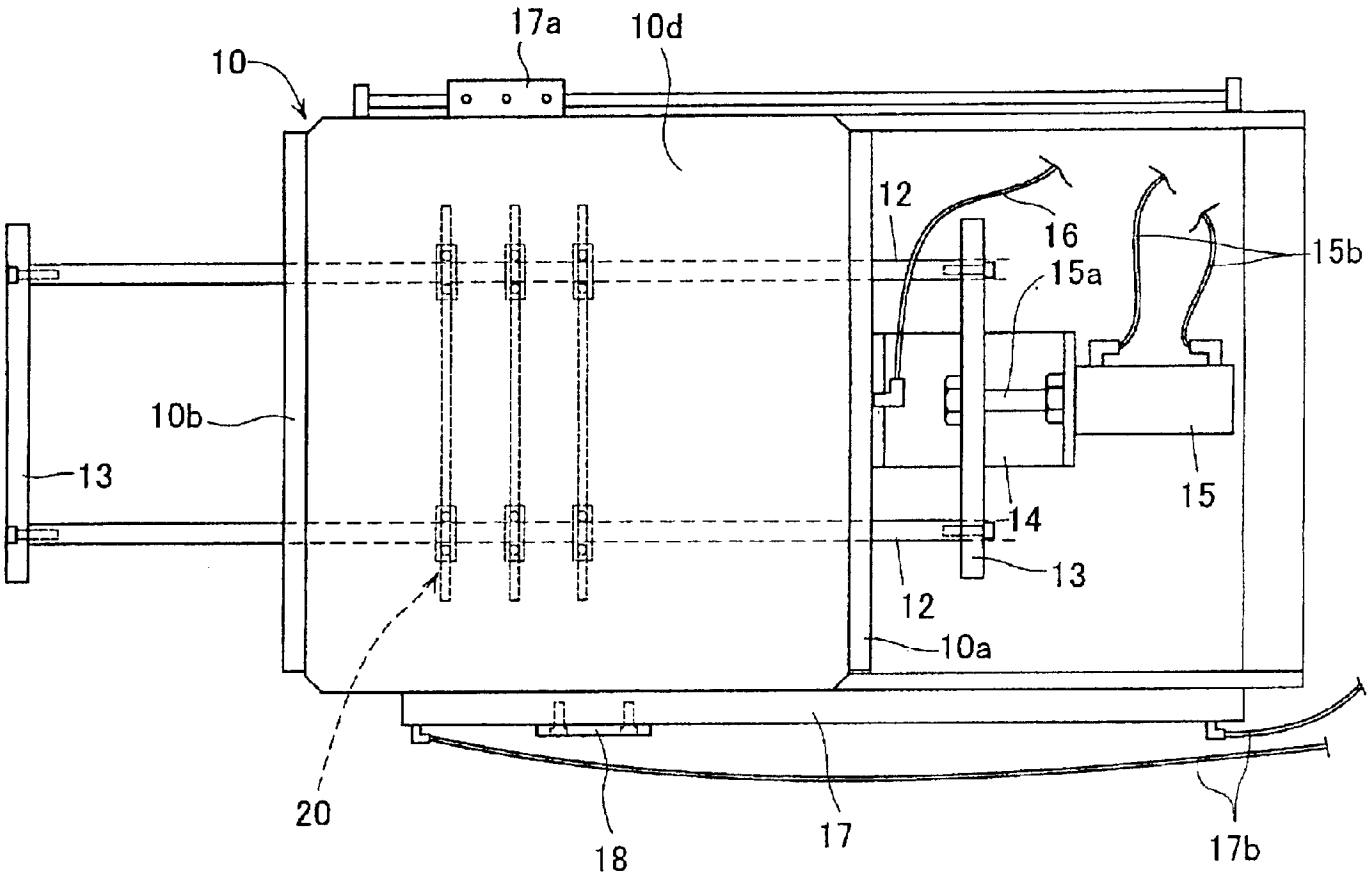
FIG. 3 is a plan view of the feeder box.
Figure 4:
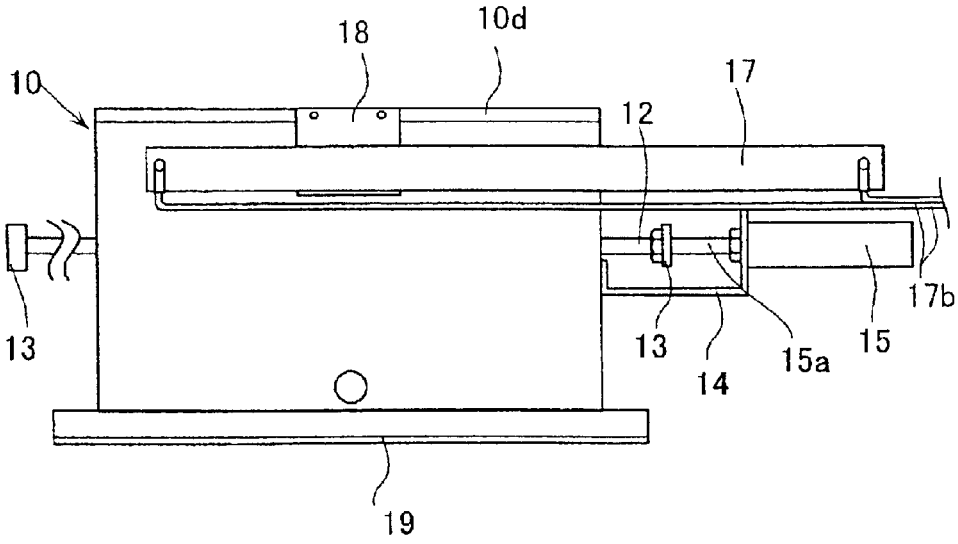
FIG. 4 is a side view of the feeder box.
Figure 5:
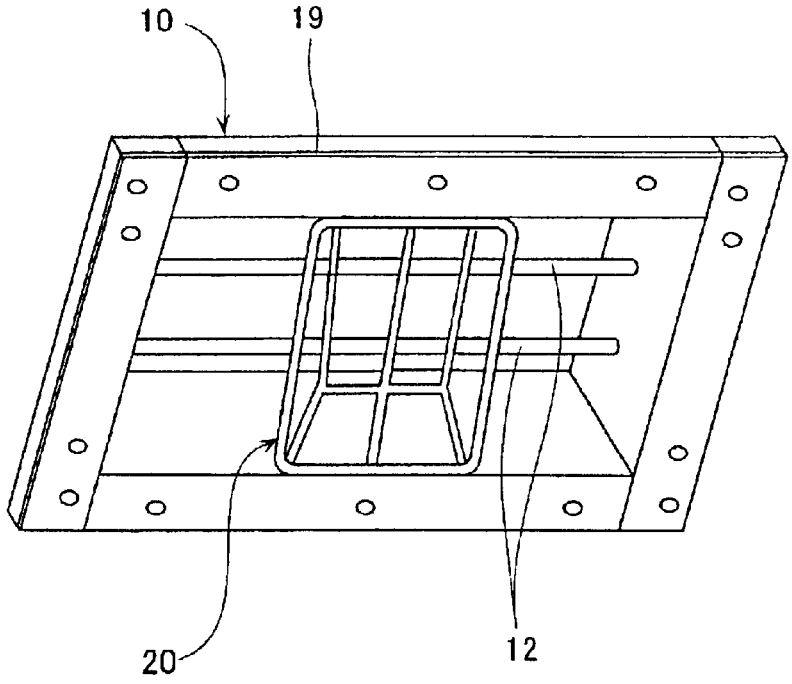
FIG. 5 is a bottom view of the feeder box.
Figure 6:
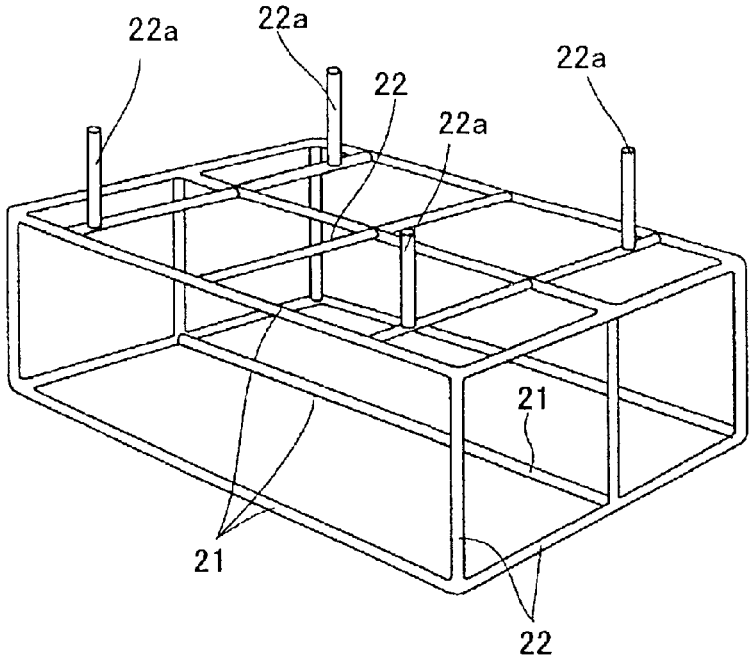
FIG. 6 is a perspective view of a bar-shaped member constituting the powder supplying apparatus.

FIGS. 3 to 6 show the detail of the feeder box. FIG. 2 is a plan view of the feeder box; FIG. 3 is a side view of the feeder box; FIG. 4 is a bottom view of the feeder box; and FIG. 6 is a perspective view of a shaker mounted within the feeder box.

The shaker 20 is fixed through a connecting bar 22*a* to two support bars 12, 12 which extend in parallel through sidewalls 10*a,* 10*a* facing the direction of movement of the feeder box 10. The two support bars 12, 12 are fixed at their opposite ends to connecting members 13, 13 by screws. A second air cylinder 15 is fixed to a fixing fitting 14 mounted externally on the right sidewall 10*a* as viewed in FIG. 4. A cylinder shaft 15*a* of the air cylinder 15 is fixed to the right connecting member 13. Thus, the shaker 20 is reciprocally moved by the reciprocal movement of the cylinder shaft 15*a* provided by air supplied from an air feed pipe 15*b* to the opposite ends of the air cylinder 15.

The shaker 20 is mounted with the feeder box 10 and provided with bar-shaped members 21 which are shown in detail in a perspective view in FIG. 6. The bar-shaped members 21 is a rounded bar member having a circular section and a diameter of 0.3 to 7 mm. The three bar-shaped members 21 are disposed in a horizontal direction, and the same number of other bar-shaped members 21 having the same shape are provided above the above-described bar-shaped members 21 with support members 22 interposed therebetween. The bar-shaped members 21 are formed integrally with one another, so that they can be reciprocally moved in the horizontal direction within the feeder box 10 by the reciprocal movement of the cylinder shaft 15*a* of the air cylinder 15.

In this embodiment, the three bar-shaped members 21, 21, 21 are disposed at distances equal to distances of the six cavities 4 disposed in the three rows in the direction of movement of the feeder box 10 with the two cavities included in each row. Thus, when the position for finally stopping each of the bar-shaped members 21 after being moved in parallel is established at a location offset from an opening surface 4*a* of the cavity 4, the bar-shaped members are stopped at the locations offset from the opening surface 4*a* for every cavities 4. In addition, the alloy powder m can be supplied at the same density into all the cavities 4 by the bar-shaped members 21.

The lower end of the lower bar-shaped member 21 is disposed at a location spaced at a distance of 0.2 to 5 mm apart from a die surface at the peripheral edge of the opening of the cavity 4. The bar-shaped member 21 is formed of a stainless steel, as is the support member 22.

A nitrogen ($N_2$) gas feed pipe 16 is provided above a central portion of the right sidewall 10*a* of the feeder box 10 to supply an inert gas into the feeder box 10. In this case, the inert gas is supplied under a pressure higher than the atmospheric pressure so as to maintain the inside of the feeder box in an inert gas atmosphere. Therefore, when the shaker 20 is moved reciprocally, the friction occurs between the shaker 20 and the alloy powder m, but the inflammation cannot be generated. The feeder box 10 is moved as the alloy powder m is caught between the bottom surface of the feeder box 10 and the base plate 1, but the inflammation cannot be generated due to the friction. Further, a friction is generated between the particles of the alloy powder within the feeder box with the movement of the feeder box, but the alloy powder cannot be inflamed.

Referring to FIG. 3, a lid 10*d* is provided to air-tightly cover the powder accommodating area 10A of the feeder box 10. The lid 10*d* must be moved rightwards as viewed in FIG. 3 in order to open the upper surface of the powder accommodating area 10A, when the alloy powder m is replenished. For this purpose, a third air cylinder 17 for driving the lid 10*d* in an opening direction is provided on the sidewall 10*b* shown on this side in FIG. 3. The air cylinder 17 and the lid 10*d* are connected to each other by a fitting 18 and fastened to each other by a screw. The lid 10*d* is usually disposed on the side of the powder accommodating area 10A of the feeder box 10 in order to maintain the inert gas atmosphere, and is moved rightwards, only when the powder is to be replenished. A guide means 17*a* is provided on the side of the lid 10*d* facing the air cylinder 17, so that the lid 10*d* can be moved smoothly, when it is driven into its opened state. Thus, a cylinder shaft (not shown) is driven by air supplied from an air feed pipe 17*b* to the opposite ends of the air cylinder 17, thereby driving the lid 10*d* for opening and closing the latter.

A plate member 19 made of a fluorine-contained resin and having a thickness of 5 mm is fixed by screwing to the bottom surface of the feeder box 10, so that the feeder box 10 is slid on the base plate 1 (and the die 2) so smoothly, thereby preventing the occurrence of the biting of the alloy powder m between the feeder box 10 and the base plate 1.

The supplying of the powder using the above-described apparatus will be described below.

Figure 7:
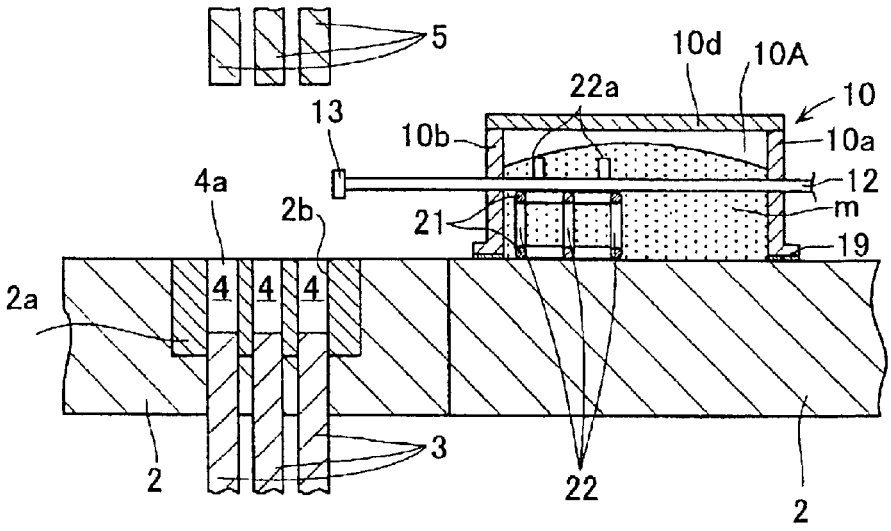
FIG. 7 is a sectional view for explaining one step of the supplying of the powder.

As shown in FIG. 1, the inert gas is already introduced into the powder accommodating area 10A through the $N_2$ gas feed pipe. The lid 10*d* of the feeder box 10 is opened to supply a predetermined amount of the alloy powder m from the feeder cup 31 to the powder accommodating area 10A. As shown in FIG. 7, after the supplying of the alloy powder m, the lid 10*d* is closed to maintain the inside of the powder accommodating area 10A in the inert gas atmosphere. It should be noted that the introduction of the inert gas into the powder accommodating area 10A is not limited only to the time when the feeder box is moved to above the cavity, but is conducted constantly, thereby reducing the fear of inflammation of the alloy powder. Any of Ar and He can also be used as the inert gas.

Figure 8:
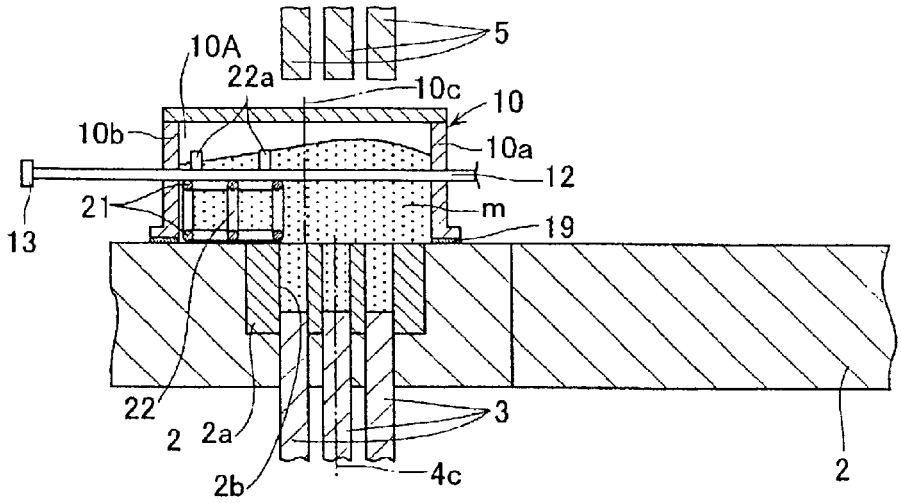
FIG. 8 is a sectional view for explaining another step of the supplying of the powder.

In this state, the air cylinder 11 is operated to move the feeder box 10 to above the cavity 4 in the die 2*a*, as shown in FIG. 8. In this case, the bar-shaped member is located in a front portion of the feeder box 10 in the moving direction. This prevents the alloy powder m present in the front portion of the feeder box 10 from being displaced backwards as viewed in the moving direction with the movement of the feeder box by keeping the bar-shaped member 21 located in a front portion of the feeder box 10 in the moving direction of the feeder box, as shown in FIG. 8, whereby the alloy powder m can be carried in a deviation-prevented state to above the cavity 4.

In addition, it is possible to facilitate the supplying of the alloy powder m under a uniform pressure into the cavity 4 by moving the feeder box 10 to a location where the center 10*c* of the feeder box 10 is beyond the center 4*c* of the cavities 4, as shown in FIG. 7. This is because even if the alloy powder m present in the front portion of the feeder box 10 in the moving direction is insufficient in amount with the movement of the feeder box 10, the amount of the alloy powder m is increased in the rear portion in the moving direction.

Figure 9:
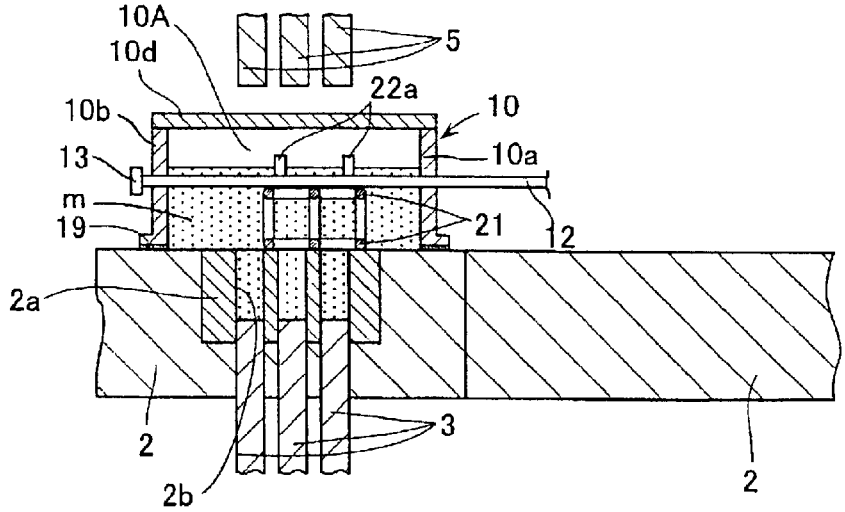
FIG. 9 is a sectional view for explaining a further step of the supplying of the powder.

After the feeder box 10 has been located above the cavity 4 in this manner, the alloy powder m in the feeder box 10 is supplied and filled into the cavity 4 lying below the feeder box 10 in the inert gas atmosphere, while moving the bar-shaped member 21 within the feeder box 10 reciprocally (for example, 5 to 15 round trips), as shown in FIG. 9. Therefore, the alloy powder m can be supplied into each of the cavities 4 with an extremely uniform filled density and with no fear of inflammation.

The finally stopping position for the bar-shaped member 21 after the parallel movement thereof is established at the location offset from the opening surfaces 4*a* of all the cavities 4, and hence, the filling of the alloy powder m into each of the cavities 4 is carried out with a uniform distribution of density.

Figure 10:
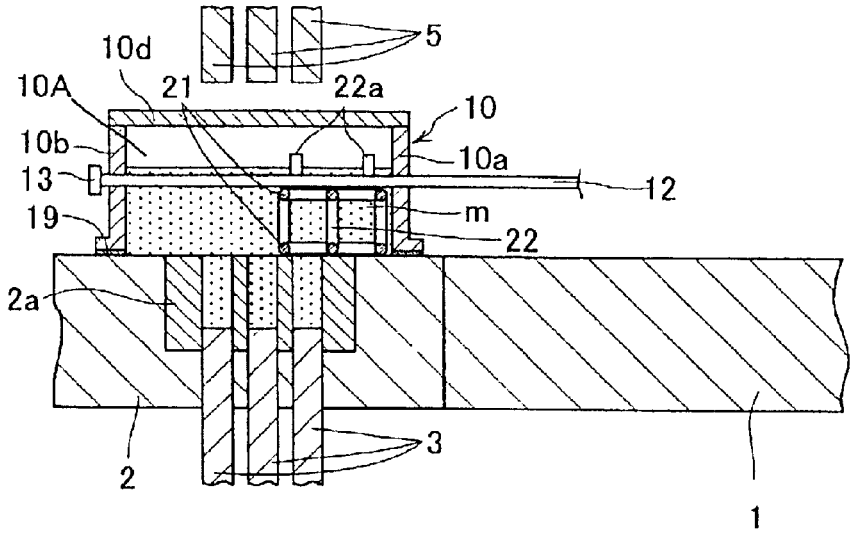
FIG. 10 is a sectional view for explaining a yet further step of the supplying of the powder.
Figure 11:
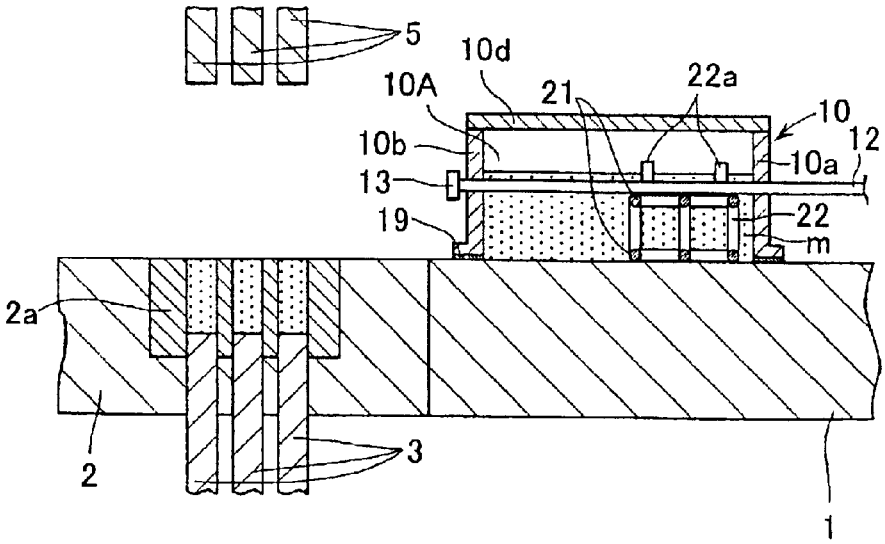
FIG. 11 is a sectional view for explaining a yet further step of the supplying of the powder.
Figure 12:
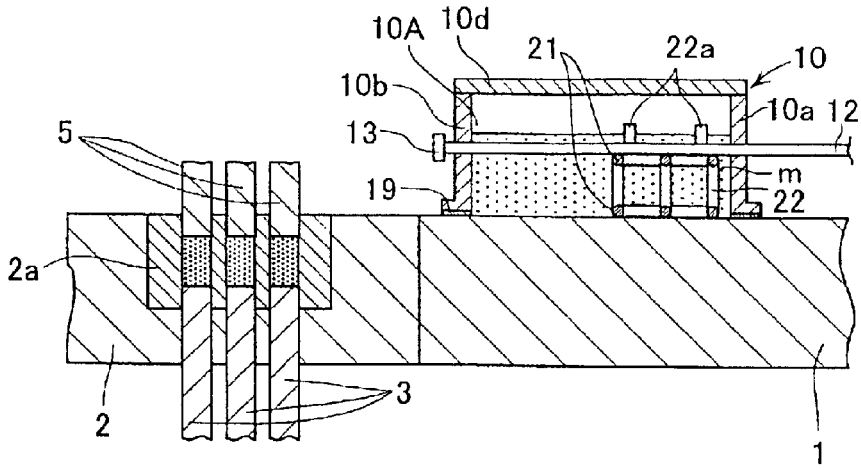
FIG. 12 is a sectional view for explaining a yet further step of the supplying of the powder.

Then, after the supplying and filling of the alloy powder m into the cavity, the bar-shaped member 21 is located in the front portion of the feeder box 10, as shown in FIG. 10, so that the alloy powder m in the front portion of the feeder box 10 in the moving (retreating) direction is prevented from being displaced backwards in the moving (retreating) direction. Thereafter, the feeder box 10 is retreated, as shown in FIG. 11, and then, the upper punch 5 is lowered to press the alloy powder m within the cavities 4, as shown in FIG. 12.

In this manner, the above-described operation is repeated to carry out the pressing of the alloy powder m continuously.

In this embodiment, since the alloy powder m is replenished accurately from the feeder cup 32 into the powder accommodating area 10A in an amount corresponding to the decrement in amount resulting from the supplying of the alloy powder m into the cavity 4, the amount of the allow powder m in the feeder box 10 can be maintained constant at all times. Therefore, the supplying of the allow powder m from the feeder box 10 into the cavity 4 can be carried out accurately.

In addition, since the plate member 19 of the fluorine-contained resin is mounted on the bottom surface of the feeder box 10 in this embodiment, and the bottom of the feeder box 10 fits on the surface of the base plate 1 (the die set 2), a portion of the alloy powder m can be prevented from being bitten between the bottom surface of the feeder box 10 and the base plate, and the alloy powder m can be supplied to the cavities 4 with no fear of inflammation.

In the pressing, a rare earth metal-based alloy green compact of a rectangular parallelepiped shape having a density of 4.4 g/cm$^3$ and a size of 40 mm×20 mm×3 mm was produced at an oriented magnetic field of 1.0 T. The green compact produced in the above manner was transported to a sintering furnace, where it was sintered for 2 hours at 1,050° C. in an Ar atmosphere and further aged for 1 hour at 600° C. in the Ar atmosphere, thereby producing a sintered magnet as described in U.S. Pat. No. 4,770,423.

The produced sintered magnets had no cracking and no chipping, and their weights were uniform.

Figure 13:
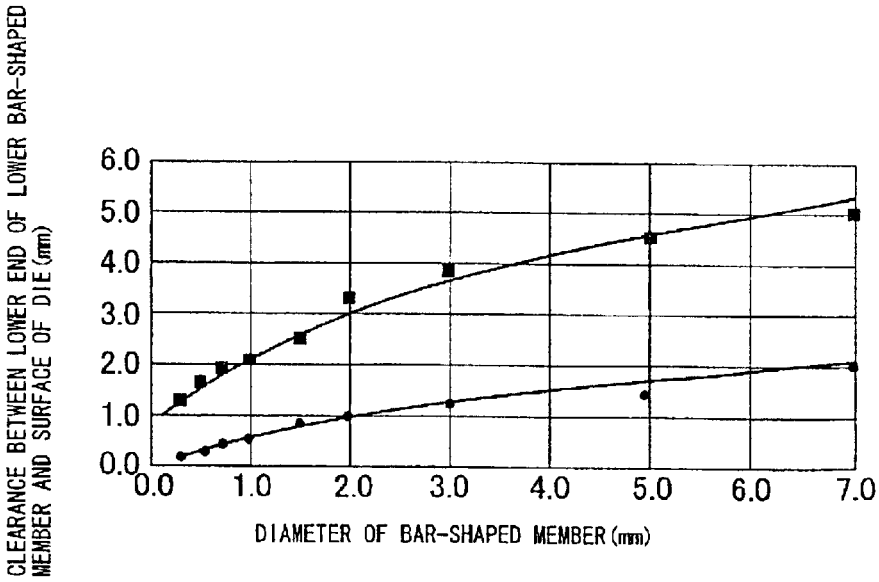
FIG. 13 is a characteristic diagram showing the relationship between the diameter of the bar-shaped member and the distance between the opening surface of a cavity and the lower end of the bar-shaped member.
Figure 14:
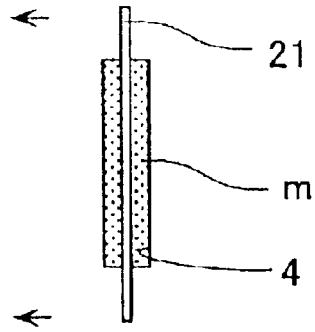
FIG. 14 is a plan view showing the filled state of the alloy powder.
Figure 15:
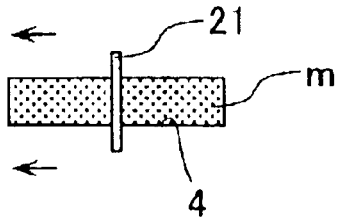
FIG. 15 is a plan view showing the filled state of the alloy powder.
Figure 16:
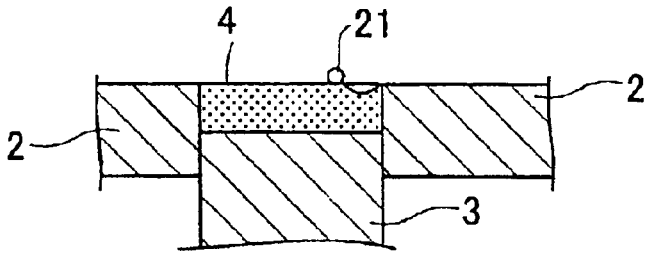
FIG. 16 is a sectional view showing the filled state of the alloy powder.

FIG. 13 shows the relationship between the diameter of the bar-shaped member 21 and the clearance between the lower end of the lower bar-shaped member 21 and the surface 4*a* of the die. In this figure, the region surrounded by two curves shows the condition that the alloy powder is filled in the cavity 4 at a uniform filled density without production of agglomerates and bridges in the alloy powder. The urging force was insufficient above the region between the curves in FIG. 13 to fail the uniform filling of the alloy powder. On the other hand, below such region, agglomerates were produced in the alloy powder. The forgoing was confirmed experimentally.

In this experiment, 24 rare earth metal-based alloy green compacts of a rectangular parallelepiped shape having a density of 4.4 g/cm$^3$ and a size of 40 mm×20 mm×30 mm were produced using the same alloy powder as in the above-described Examples at an oriented magnetic field of 1.0 T by pressing operation using the same pressing machine as in the above-described Examples. The compacts were sintered for 2 hours at 1,050° C. in an Ar atmosphere and further aged for 1 hour at 600° C. in the Ar atmosphere to produce sintered magnets. Thereafter, the size of each of the produced sintered magnets was measured. As a result, the sizes of all the sintered magnets were in the region surrounded by the two curves within an error of ±2%.

What is claimed:

1. An apparatus for supplying a rare earth metal-based alloy powder from a feeder box having an opening in its bottom into a cavity by moving said feeder box to above said cavity, said apparatus comprising an inert gas supply device for filing an inert gas into said powder feeder box under a pressure higher than the atmospheric pressure.

2. An apparatus for supplying a rare earth metal-based alloy powder according to claim 1, wherein the feeder box is slid on a die.

3. An apparatus for supplying a rare earth metal-based alloy powder from a feeder box having an opening in its bottom into a cavity by moving said feeder box to above said cavity and filing the powder into the cavity by gravity, said apparatus comprising an inert gas supply device for filing an inert gas into said powder feeder box continuously.

* * * * *